US005868289A

United States Patent [19]

Lee

[11] Patent Number: 5,868,289

[45] Date of Patent: Feb. 9, 1999

[54] STIFFENED FOLDED PAPERBOARD HANGER

[76] Inventor: Sun Jae Lee, 518, Choi-dong, Hanam-si, Kyunggi-do, Rep. of Korea

[21] Appl. No.: 715,477

[22] Filed: Sep. 18, 1996

[51] Int. Cl.[6] ..... A47G 25/36; A47G 25/14

[52] U.S. Cl. ..... 223/87; 223/85; 223/88

[58] Field of Search ..... 223/87, 85, 88, 223/92

[56] References Cited

U.S. PATENT DOCUMENTS

| | | | |
|---|---|---|---|
| 1,619,742 | 3/1927 | Mayhew | 223/87 |
| 1,760,352 | 5/1930 | Feigelman | 223/87 |
| 2,337,828 | 12/1943 | Lipman | 223/87 |
| 2,355,969 | 8/1944 | Gustin | 223/87 |
| 2,355,984 | 8/1944 | Lupton | 223/87 |
| 4,155,493 | 5/1979 | Palmaer . | |
| 4,391,395 | 7/1983 | Karner . | |
| 5,297,706 | 3/1994 | Blitz . | |
| 5,381,938 | 1/1995 | Vasudeva . | |

FOREIGN PATENT DOCUMENTS

| | | | |
|---|---|---|---|
| 6700643 | 1/1967 | Netherlands | 223/87 |
| 650516 | 2/1951 | United Kingdom | 223/87 |

*Primary Examiner*—Bibhu Mohanty

*Attorney, Agent, or Firm*—Oblon, Spivak, McClelland, Maier & Neustadt, P.C.

[57] ABSTRACT

A folded paperboard hanger including a slant plate part having two slant portions, a connecting plate part connecting end portions of the slant portions so as to make an approximate isosceles triangular formation, a hanging plate part formed as an one body together with the slant plate part for hanging the hanger, and a reinforcement plate part extended from one of the slant plate part and the connecting plate part. The reinforcement plate part is fixed by folding the reinforcement plate part so as to form an approximate right angle between the reinforcement plate part and the one of the slant plate part and the connecting plate part. An extending plate part is formed inside the connecting plate part and has a pair of hanging lugs. The extending plate part is folded by an angle of approximate 180 degrees such that the pair of hanging lugs are positioned at an opposite side of the hanging plate part with respect to the connecting plate part.

5 Claims, 4 Drawing Sheets

STIFFENED FOLDED PAPERBOARD HANGER

BACKGROUND OF THE INVENTION

FIELD OF THE INVENTION

Material civilization of today has been developed from the past ceaselessly and repeatedly, therefore makes each field of industry bring a remarkable development. As a result of such material civilization development, the human consumption life became a variety, at the same time an environment of the earth came up to a situation we can't look on unconcerned any more. The present invention relates to a stiffened folded paperboard hanger provided by a consideration of the earth's environment being polluted.

DISCUSSION OF THE BACKGROUND

Generally, the folded paperboard hanger is made out of paperboard folded by adhering of several pieces paperboards of a given thickness together, and then this paperboard is cut and made in a form of a hanger we want to. That is, adherence of several pieces paperboards makes the folded paperboard, this folded paperboard is cut, and then the hanger is made. This is why in the present technique of a paper manufacture the paperboard more than a given thickness (about 0.75 mm) can't be made, in the hanger case of paper material we can get a sufficient strength as the hanger if we have to make it much thicker (about 2.5 mm) than the paperboard thickness makable by the present paper manufacture technique.

Meanwhile, the folded paperboard hanger made by above-mentioning is getting shrunk according to an adhesive dryness between the paperboards, and even any one is transformed upward and downward against the surface. According to a time lapse the transformation degree gets heavy and the function is lost. In such transformation of the folded paperboard hanger, it is transformed only upward and downward against the surface not the transformation of a horizontal direction on the surface. The transformation only upward and downward is why an endurable bending moment of the horizontal direction side on the surface of folded paperboard hanger can resist a contractile force, but the endurable bending moment upward and downward against the surface can't resist the contractile force. Such a difference of the endurable bending moment between the horizontal direction side and the upward and downward sides against the surface may be explained in a resistance moment formula, or a bending formula of beam, of a mechanics of materials. That is, supposing the folded paperboard is BEAM, the endurable bending moment M, an endurable bending stress $\delta$, a BEAM's section modulus Z, a BEAM's width b and a BEAM's height h, it becomes $M=\delta Z$. That is, the endurable bending moment M is proportionated to the section modulus Z. Therefore, the section modulus of all beams is increased largely according to height increase rather than width's. The section modulus Z of upward and downward sides against the surface of folded paperboard hanger is even fewer than the section modulus Z of horizontal direction side on the surface of folded paperboard hanger. Namely the folded paperboard hanger is transformed only upward and downward against the surface, that is, towards that the endurable bending moment and the strength are weak.

SUMMARY OF THE INVENTION

It is therefore, an object of the present invention to provide a stiffened folded paperboard hanger being capable of preventing a folded paperboard hanger's transformation without an increase of product cost, and to provide another stiffened folded paperboard hanger proper to children's clothes.

In accordance with the present invention to achieve the above-mentioned object, a stiffened folded paperboard hanger is provided as follows. In the folded paperboard hanger that a slant plate part and a connecting plate part are formed in one body so as an approximate isosceles triangular form to be made, and on the upside of the slant plate part a hanging plate part is prolonged and formed in one body, a reinforcement plate part, which is extended from one plate part at least selected between the slant plate part and the connecting plate part, is formed. This reinforcement plate part is fixable in the folded state so that it may be roughly at a right angle to the selected plate part. In a case of folding and fixing the reinforcement plate part at approximate right angle to the selected plate part, in the stiffened folded paperboard hanger according to the present invention as the above, the reinforcement plate part supports and reinforces the selected plate part of the horizontal direction on the surfaces direction which the section modulus is large.

In another stiffened folded paperboard hanger of the present invention, the connecting plate part is extended long downwards, and also on the side parts of the upward and downward sides, hanging lugs are formed symmetrically mutually. On the inner sides of connecting plate part an extending plate part of approximate square shape is formed so as it to be foldable towards the lower side of connecting plate part, and also on the side parts of upward and downward parts of the extending plate part, the hanging lugs are formed symmetrically mutually. In a case of folding and fixing the extending plate part towards the lower side of connecting plate part, the hanging lugs formed on the extending plate part are situated on the lower side of connecting plate part. In another stiffened folded paperboard hanger of the present invention as the above, upper garments can be hung on the slant plate part, children's comparative long trousers can be hung on the hanging lugs formed on the connecting plate part, and children's comparative short trousers can be hung selectively on the hanging lugs formed on the extending plate part.

BRIEF DESCRIPTION OF THE DRAWINGS

The above objects and other advantages of the present invention will become more apparent by describing the preferred embodiment of the present invention with reference to the attached drawings, in which.

DETAILED DESCRIPTION OF THE PREFERRED EMBODIMENT

In the following description, numerous specific details are set forth to provide a more thorough understanding of the present invention. It will be apparent, however, to one skilled in the art, that the present invention may be practiced without these specific details. In other instances well known devices have not been described so as not to obscure the present invention.

The following illustrates preferable embodiments of the present invention, referring to attached diagrams.

Figure 1:
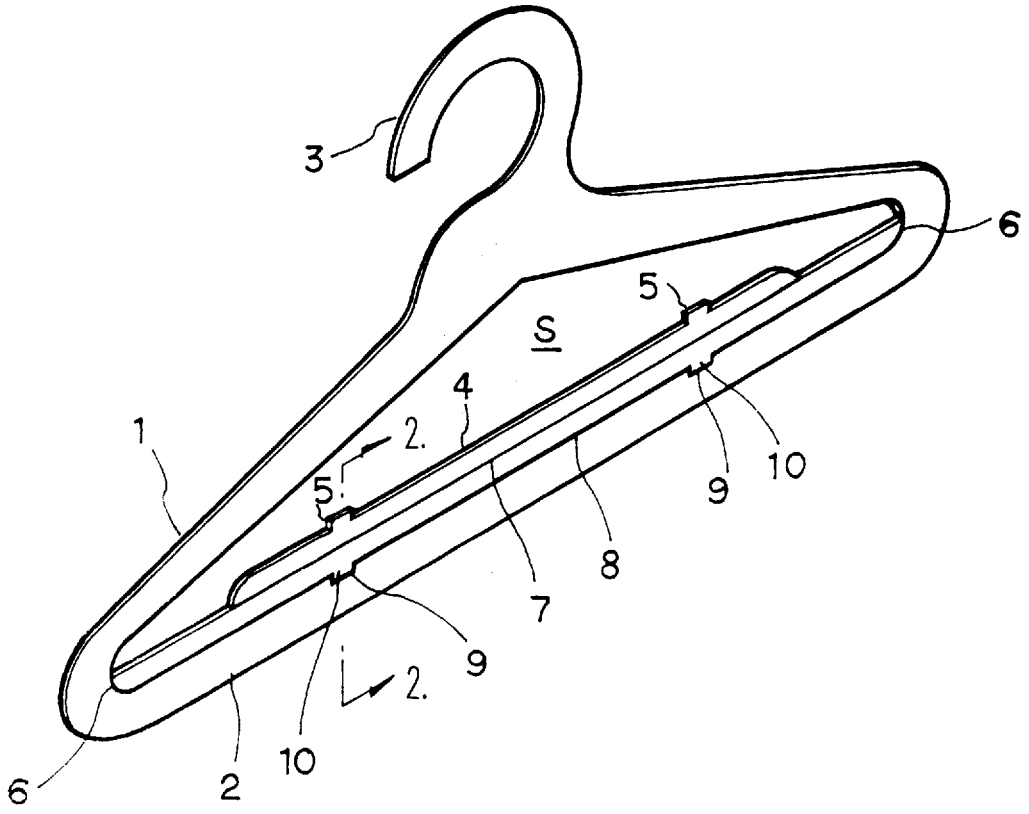
FIG. 1 is a perspective view of the present invention.
Figure 2:
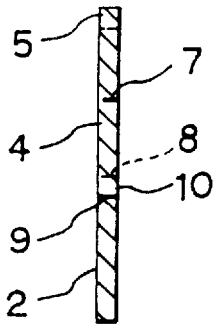
FIG. 2 is an enlarged sectional view of line I—I showing in FIG. 1.

The first embodiment is provided as follows. FIG. 1 shows a perspective view of the present invention. A stiffened folded paperboard hanger of the present invention is made out of several pieces of adherence paperboards by using an adhesive in the same method as a conventional one, and is made out of cutting this folded paperboard in a given shape or forming a slit. A completed shape and its construction are as follows. An indicative number 1 is a slant plate part of an approximate "Λ" shape, and a connecting plate part 2 extended from both lower sides of the slant plate part 1 is formed in one body. Extending from an upper angle part of the slant plate part 1, a hanging plate part 3 is formed in one body upwards. With such construction the stiffened folded paperboard hanger of the present embodiment makes an approximate isosceles triangular form.

An indicative number 4 is a reinforcement plate part formed with the connecting plate part 2 in one body, and the reinforcement plate part 4 is formed towards a space part S of inner side of the slant plate part 1. Extending from the upside of this reinforcement plate part 4, fixation plates 5 are formed in projection shapes with a given interval. In a boundary part between the reinforcement plate part 4 and the slant plate part 1, cut parts 6 are formed. In the center of reinforcement plate part 4, a slit 7 is formed from the surface side along the length direction. In the boundary part between the reinforcement plate part 4 and the connecting plate part 2, another slit 8 horizontal with the slit 7 is formed from the surface side. In the midst of the slit 8 also cut parts 9 of shapes confronted with the upper end sides of fixation plates 5 are formed. By this cut parts 9 lug plates 10 are formed extending from the reinforcement plate part 4. When the stiffened folded paperboard hanger is used according to the present invention constructed as the above-mentioned, it is used in the folded state and fixed state of the reinforcement plate part 4 at an approximate right angle to the connecting plate part 2. Folding and fixing process of the reinforcement plate part 4 is as follows.

Figure 3:
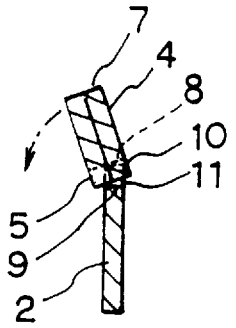
FIG. 3 is an enlarged longitudinal sectional view in the midst of folding process of a reinforcement plate part shown in FIG. 2.
Figure 4:
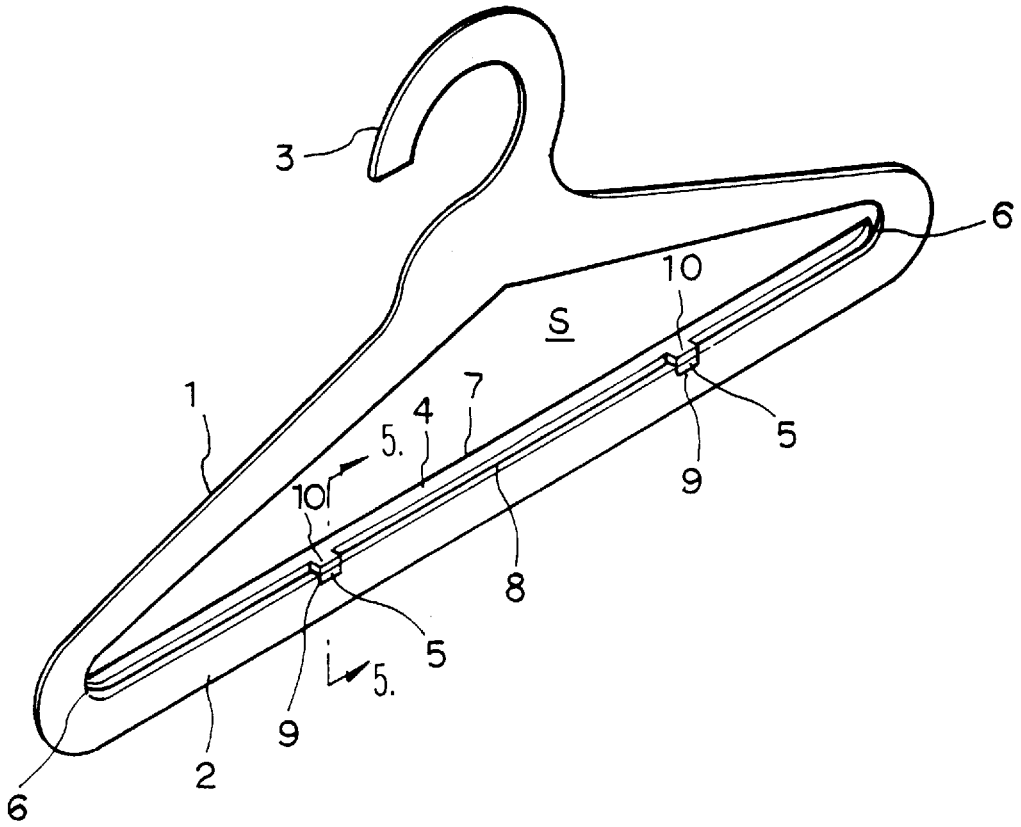
FIG. 4 is a perspective view of the reinforcement plate part folded and fixed.
Figure 5:
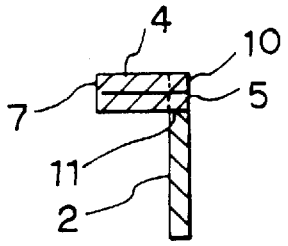
FIG. 5 is an enlarged sectional view of line II—II showing in FIG. 4.

As showing in FIG. 3, the upper side of reinforcement plate part 4 is folded towards a flesh side in a standard of the slit 7 formed in the center of reinforcement plate part 4. According to folding the reinforcement plate part 4 in two folds, in the reinforcement plate part 4 a transformation upward and downward against the surface owing to a shrinkage is prevented, and the strength increases double. In the standard of the slit 8 formed in the boundary part between the reinforcement plate part 4 and the connecting plate part 2, when the reinforcement plate part 4 is folded towards the flesh side of connecting plate part 2, the lug plates 10 emerge from the cut parts 9. By getting out of the cut parts 9, fixation slots 11 are formed in an interval between the cut parts 9 and the flesh sides of lug plates 10. As showing in FIGS. 4 and 5, in the state of control so that the reinforcement plate part 4 may be approximately at the right angle to the connecting plate part 2, when the fixation plates 5, which is formed with the reinforcement plate part 4 in one body, are inserted into the fixation slots 11, the reinforcement plate part 4 is fixed as the state that outer end side adheres closely to the flesh side of connecting plate part 2. Herewith the fixation plates 5 is inserted by force and fixed, therefore a fixing state of the reinforcement plate part 4 is maintained strongly, and also supports and reinforces strongly to the connecting plate part 2.

Accordingly, even if shrinkage by a dryness of the adhesive in the reinforcement plate part 4 itself inner is caused, in the present invention the transformation of reinforcement plate part 4 is not caused, not only towards the direction horizontal with the surface which a section modulus is large, but also upward and downward against the surface. Since the reinforcement plate part 4 supports and reinforces the connecting plate part 2 by the stiffened surface direction which the section modulus is large, in connecting plate part 2 the transformation by shrinkage upward and downward against the surface side can be prevented. Thereby, whole transformation can be prevented.

Meanwhile, in the present embodiment though it is formed in one body of the reinforcement plate part and the connecting plate part in the inside of slant plate part, it is natural that an improved change is included in a technique range of the present invention. Namely there can be the improved change like as a formation of one body of the reinforcement plate part and the slant plate part, or like as a formation of the reinforcement plate part on the outsides of the connecting plate part or the slant plate part, etc.

Figure 6:
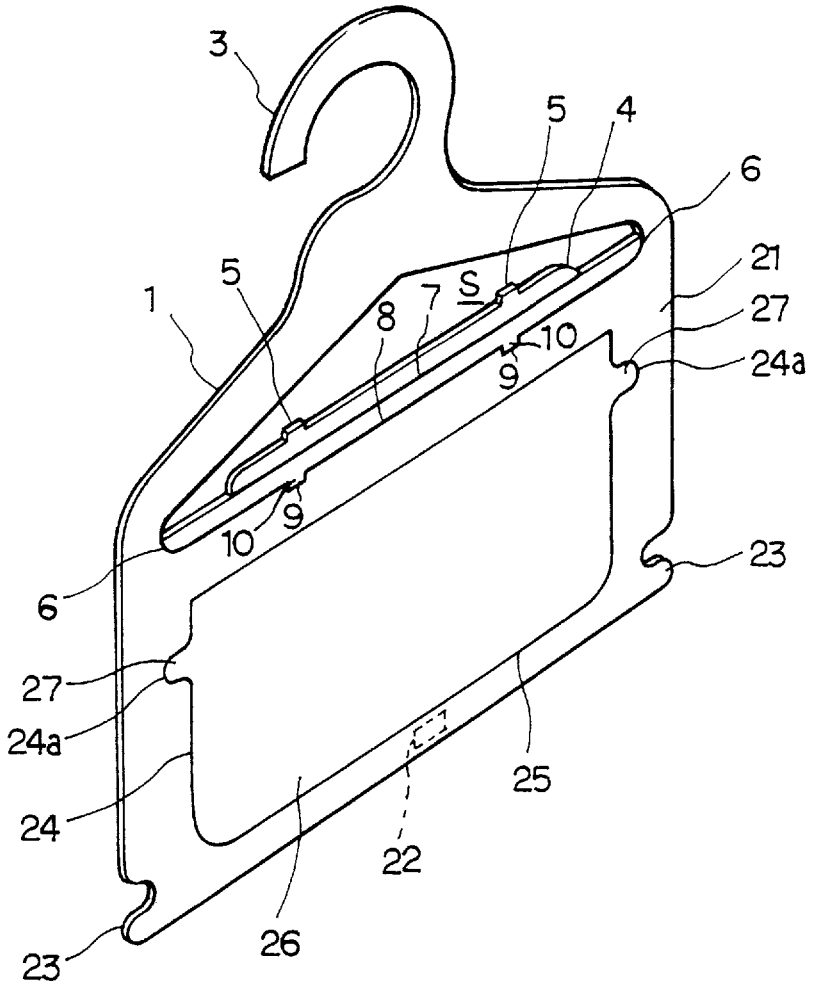
FIG. 6 is a perspective view for showing another embodiment of the present invention.

The second embodiment of the present invention is provided in the following. FIG. 6 shows a perspective view of the second embodiment of the present invention. The untransformable folded paperboard hanger provided in the present embodiment is an improved one from the stiffened folded paperboard hanger of the first embodiment so that it may be proper to children's clothes. Its construction is as follows. The same parts in the constructions of the present embodiment and the first embodiment have the same codes on the diagrams.

The construction of the first and the second embodiments is almost same in the formation of one body for the slant plate part 1, the connecting plate part 2 and the hanging plate part 3, and in the formation of one body for the reinforcement plate part 4 and the connecting plate part 2 in the inside of the slant plate part 1. But in the stiffened folded paperboard hanger of the second embodiment, whole width is a little narrower than the first embodiment's, so as it to be proper to children's clothes. Also, the connecting plate part 21 is formed long towards the lower side from the connecting plate part 2 in the previous embodiment, and the adhesive 22 is spread near the lower side on the flesh side of connecting plate part 21. On both side parts of the upward and downward sides of connecting plate part 21, the hanging lugs 23 are formed symmetrically near the lower side. In the inside of connecting plate part 21 a cut part 24 of "Π" shape is formed, and in the midst between upward and downward sides of this cut part 24, projection parts 24*a* are formed symmetrically near the upside. Connecting the lower side of the cut part 24 also the slit 25 is formed from the surface. In the inside of connecting plate part 21 the extending plate part 26 is formed by the cut part 24 and the slit 25. On both side parts of the upward and downward sides of this extending plate part 26, the hanging lugs 27 are formed symmetrically by the projection parts 24*a* of cut part 24.

Figure 7:
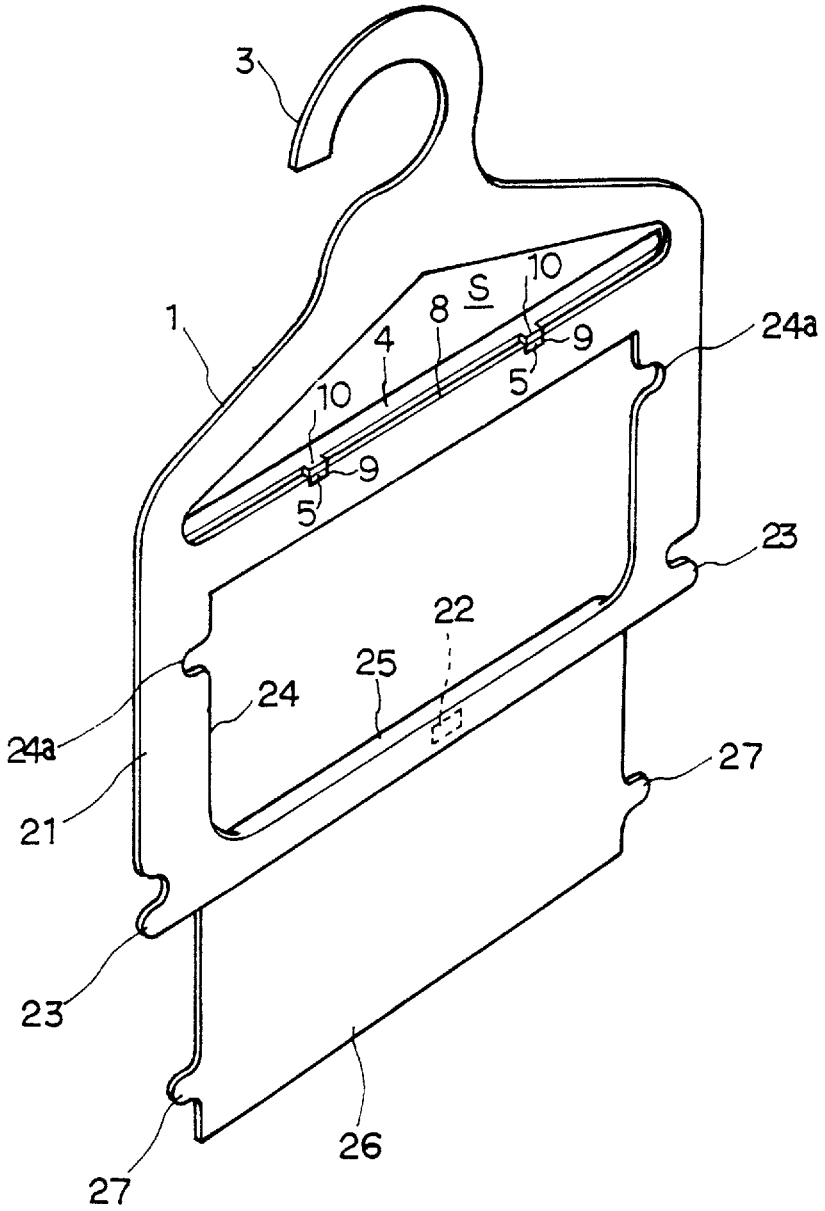
FIG. 7 is a perspective view of a state that the reinforcement plate part is folded and fixed, and an extension plate part is folded and fixed towards the lower part of a connecting plate part, in FIG. 6.

In using the stiffened folded paperboard hanger of the present embodiment constructed as the above, as showing in FIG. 7, the extending plate part 26 is folded towards the lower side of flesh side of connecting plate part 21 in the standard of the slit 25. And then the hanging lugs 27 formed on the extending plate part 26 are projected below the connecting plate part 21. Under this state, the extending plate part 26 is fixed to the adhesive 22 spread on the flesh side of connecting plate part 21. Also the reinforcement plate part 4 is folded and fixed for supporting and reinforcing the connecting plate part 21 in the same method as the first embodiment.

Accordingly, in the stiffened folded paperboard hanger of the present embodiment as the above-mentioned, the slant plate part 1 can be used to hang the upper garments, the hanging lugs 23 formed on the connecting plate part 21 to hang children's comparative long trousers, and the hanging lugs 27 formed on the extending plate part 26 selectively to hang children's comparative short trousers. The connecting plate part 21 is supported and reinforced by the reinforcement plate part 4 like as the first embodiment, therefore even though the adhesive is dried and shrunk after manufacturing, not only for the connecting plate part 21 but also for the whole in one body with the connecting plate part 21 the transformation is prevented.

The present invention with the above construction and action provides the following effects. In the stiffened folded paperboard hanger showing in claim 1, extending from the connecting plate part the reinforcement plate part is formed, and the reinforcement plate part is fixable in the folding state at the right angle to the connecting plate part. By folding and fixing the reinforcement plate part approximately at the right angle to the connecting plate part, the connecting plate part is supported and reinforced. Accordingly, not only the transformation of connecting plate part but also the whole transformation formed in one body with the connecting plate part can be prevented. Also since the reinforcement plate part is formed by using the folded paperboard of inner side of slant plate part, in comparison with conventional folded paperboard hanger a price increase element is not caused, either. Therefore the stiffened folded paperboard hanger of claim 1 can provide the folded paperboard hanger without the transformation problem and without a increase of product cost, furthermore a durability of the folded paperboard hanger can be advanced largely.

The stiffened folded paperboard hanger showing in claim 2 has effects of claim 1 undoubtedly. At the same time, since the hanging lugs may be formed on the side parts of connecting plate part and on the lower side parts of extending plate part with a given interval, on the slant plate part the upper garments can be hung, on the hanging lugs formed on the connecting plate part children's comparative long trousers can be hung, and on the hanging lugs formed on the extending plate part children's comparative short trousers can be hung selectively. So it can be used usefully in a small shop for handling children's clothes.

What is claimed is:

1. A folded paperboard hanger comprising:

a slant plate part having two slant portions including end portions respectively;

a connecting plate part connecting said end portions of said slant portions so as to make an approximate isosceles triangular formation;

a hanging plate part formed as an one body together with said slant plate part for hanging the hanger;

a reinforcement plate part extended from one of said slant plate part and said connecting plate part, said reinforcement plate part being fixed by folding said reinforcement plate part so as to form an approximate right angle between said reinforcement plate part and said one of said slant plate part and said connecting plate part; and an extending plate part formed inside said connecting plate part and having a pair of hanging lugs, said extending plate part being folded by an angle of approximate 180 degrees such that said pair of hanging lugs are positioned at an opposite side of said hanging plate part with respect to said connecting plate part.

2. The folded paperboard hanger according to claim 1, wherein said connecting plate part has another pair of hanging lugs.

3. A folded paperboard hanger comprising:

a slant plate part having two slant portions including end portions respectively;

a connecting plate part connecting said end portions of said slant portions so as to make an approximate isosceles triangular formation;

a hanging plate part formed as an one body together with said slant plate part for hanging the hanger; and a reinforcement plate part extended from said connecting plate part, said reinforcement plate part having a first slit and a second slit which is formed at a boundary of said reinforcement plate part and said connecting plate part, said reinforcement plate part including a fixation projection at an opposite side of said second slit, a cut part being formed at said second slit such that a lug plate and a fixation slot are formed at said cut part when said reinforcement plate part is folded along said second slit, said reinforcement plate part being fixed by folding said reinforcement plate part at said first and second slits so as to form an approximate right angle between said reinforcement plate part and said connecting plate part and so as to introduce said fixation projection into said fixation slot.

4. The folded paperboard hanger according to claim 3, wherein said connecting plate part has an extending plate part inside thereof including a pair of hanging lugs, said extending plate part being folded by an angle of approximate 180 degrees such that said pair of hanging lugs are positioned at an opposite side of said hanging plate part with respect to said connecting plate part.

5. The folded paperboard hanger according to claim 4, wherein said connecting plate part has another pair of hanging lugs.

* * * * *